United States Patent [19]

Ask et al.

[11] Patent Number: 4,812,953

[45] Date of Patent: Mar. 14, 1989

[54] SAFETY LIGHT BAND

[75] Inventors: Willy G. Ask, Ulricehamn; E. Peter M. Wahlberg, Boras, both of Sweden

[73] Assignee: Newline Electronic AB, Ulricehamn, Sweden

[21] Appl. No.: 165,172

[22] Filed: Mar. 7, 1988

[51] Int. Cl.[4] ..... F21L 15/08

[52] U.S. Cl. ..... 362/103; 362/251; 362/234

[58] Field of Search ..... 362/103, 800, 249, 251, 362/234, 108, 806, 158, 245, 253, 247, 227

[56] References Cited

U.S. PATENT DOCUMENTS

| | | | |
|---|---|---|---|
| 3,720,918 | 3/1973 | Perl | 362/103 |
| 3,944,803 | 3/1976 | Chao | 362/108 |
| 4,173,201 | 11/1979 | Chao et al. | 362/103 |
| 4,425,600 | 1/1984 | Bernhart | 362/103 |
| 4,521,832 | 6/1985 | Barbour | 362/251 |
| 4,523,258 | 6/1985 | Morse et al. | 362/800 |
| 4,709,307 | 11/1987 | Branom | 362/103 |

*Primary Examiner*—Ira S. Lazarus
*Assistant Examiner*—D. M. Cox
*Attorney, Agent, or Firm*—Body, Vickers & Daniels

[57] ABSTRACT

A safety light band maximizes visibility of a pedestrian wearing the band in poorly lighted or unlighted conditions. The band is formed as a flexible strap having fastening means for wearing the band on the person, and luminous means comprising an interactive combination of electric lamps and reflective surfaces.

1 Claim, 2 Drawing Sheets

SAFETY LIGHT BAND

The present invention pretains to the art of safety accessories worn to increase the visibility of the wearer in poorly lighted conditions, and particularly to a safety light band with highly visible electric light means.

BACKGROUND OF THE INVENTION

Poor visibility is a serious problem for pedestrians in environments closely shared with vehicular traffic. Exposure to traffic can be an occupational or a recreational hazard, and is an experience shared by nearly everyone on a daily basis. The difficulty of maneuvering oneself safely on foot in a roadway is well known to police officers, firefighters, construction workers, and the occasionally stranded motorist. The danger of being struck by a vehicle is increased tremendously under conditions of poor visibility, and such conditions frequently are attributable to weather as well as darkness of night. For this reason, poor visibility in traffic is a hazard common to schoolchildren and other usual daytime pedestrians, as well as to the large number of fitness minded persons who have taken up jogging or cycling in recent years and who can find time to do so only in the evening hours.

Attempts to increase pedestrian visibility have involved the use of brightly colored article of clothing, and the use of reflectors on or incorporated into clothing.

The problem with brightly colored articles of clothing as a safety measure is primarily the reluctance of most people to wear them. For example, the well known orange vests worn by utility or construction personnel are considered prohibitively unsightly for general use and thus are strictly limited in their application. Conspicuously bright colors alone are impractical as features of even recreational clothing for which many consider fashion as important as utility. Even when worn dutifully, brightly colored safety clothing serves only to distinguish the wearer from other visible objects, and offers little or no protection in conditions of darkness.

The problem with reflectors as safety features is that visibility in a darkened environment is provided only when a beam of light is directed against the reflective surface. This arrangement may not be sustained sufficiently, if at all, for a motorist to identify a pedestrian in time to take evasive action. Furthermore, a mere reflection alone cannot convey a sense of alarm as may be desired by a stranded motorist or other person wishing to attract attention and assistance.

A disadvantage common to both reflectors and bright colors is that both types of safety accessories are limited to the associated article of clothing, and cannot be adapted for use with pets or other objects requiring conspicuous visibility in darkened environments.

Known safety accessories for increasing pedestrian visibility are thus seen to fail to enable effective visibility continuously under conditions of darkness, and lack universal appeal in occupational, recreational, or other circumstances calling for enhanced visibility of the wearer.

SUMMARY OF THE INVENTION

The present invention overcomes the above referred to problems and others and provides a safety light band with universal appeal and application to pedestrians, pets, or other objects dangerously exposed to vehicular traffic, and which provides continuous and conspicuous visibility in unsafe conditions of darkness.

In accordance with one principal feature of the invention, there is provided a safety light band for enabling visibility of an object in a dark environment. A flexible band is adapted to wrap around the object, which may be a limb of the human body, and includes battery powered electric lighting apparatus for enabling visibility of the band.

In accordance with a specific feature of the invention, the battery powered electric lighting apparatus includes a number of light emitting diodes, and may further include an electrical controller for causing the light emitting diodes to flash on and off.

A further specific feature of the invention is the provision of a battery pouch with the light band to house the battery required for the lighting apparatus.

In accordance with another specific feature of the invention, the safety light band is formed of layers between which the electrical components are housed. The layered construction may be a composite of plastic, fabric, or other flexible materials arranged to securely house the electrical components, provide visible reflective surfaces, and to accommodate wearing comfort and durability.

In accordance with another specific feature of the invention, the flexible band is formed as an elongated member which is long enough to wrap around the object with its ends overlapping, and has fastening components to releasably hold the overlapping ends in the wrapped position. The fastening components may be "Velcro" brand or comparable hook and loop surfaces.

In acordance with another principal feature of the invention, a safety device for enabling visibility of an object in a dark environment is provided as a two-sided flexible sheet. The sheet has fastening components for mounting on the object, which may be a limb of the human body, and on one side has luminous components for enabling visibility of the sheet.

In accordance with another specific feature of the invention, the luminous components include battery powered light emitting diodes, and may further include an electrical controller for causing the diodes to flash on and off.

In accordance with yet another specific feature of the invention, the sheet is a strap which is long enough to wrap the object with the strap ends overlapping. The fastening components may be "Velcro" brand hook and loop surfaces at the overlapping ends, and the strap may further include a pouch for housing a battery.

The principal object of the present invention is to provide a safety light band which enables visibility of a pedestrian wearing the band in an environment of poor visibility.

Another object of the invention is to provide a high visibility safety light band which is easy to use and which conforms to the appearance requirements of both occupational and non-occupational users, whereby the safety light band has universal applicability as a device to be worn on the person.

A further object of the invention is to provide a safety light band having battery operated electric lighting apparatus to enable visibility of the wearer in the absence of an external source of light.

Still a further object of the invention is to provide a high visibility safety light band which can interchangeably be worn on the person, worn on pets, or mounted on inanimate objects sought to be made visible or to have attention brought thereto under conditions of darkness.

These and further objects of the invention will become apparent from the following detailed description of a preferred embodiment and from the accompanying drawings.

DESCRIPTION OF A PREFERRED EMBODIMENT

Figure 1:
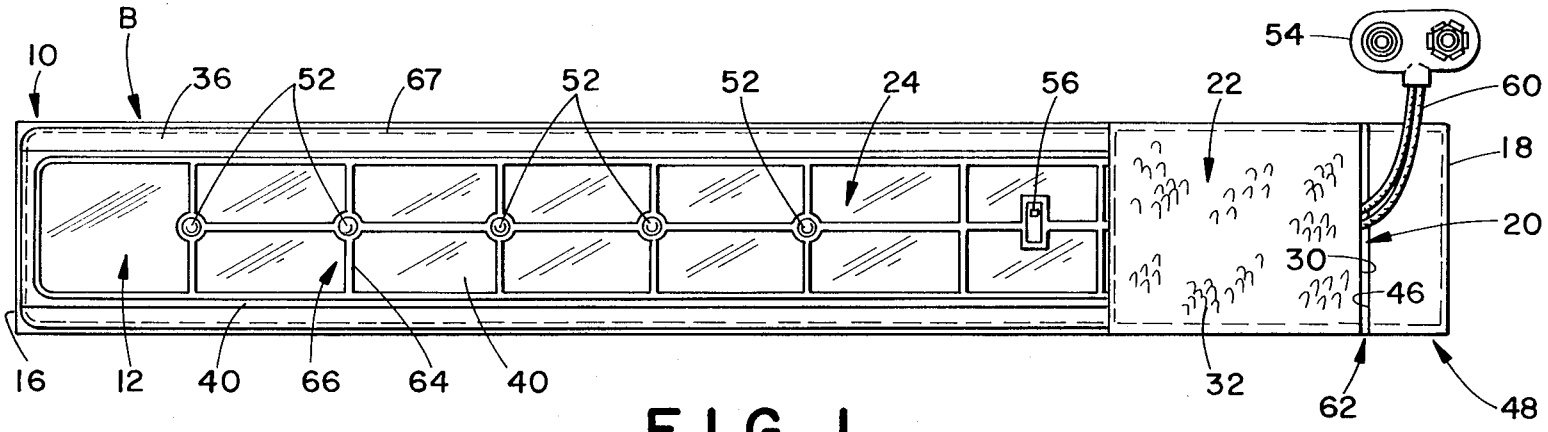
FIG. 1 is a front elevation view of a safety light band in accordance with the invention.

Referring now to the drawings wherein the showings are for the purpose of illustrating a preferred embodiment of the invention only and not for the purpose of limiting same, in FIG. 1 there is shown a front elevation view of a safety light band B formed as a two sided strap 10. The strap 10 is flexible and of sufficient length to wrap around a limb of the human body or other object to be provided with enhanced visibility and comprises a front planar side 12 a rear planar side 14, opposite ends 16 and 18, and a battery pouch 20 near the end 18. Also included is a fastening means 22 adapted to engage the strap 10 in a wrapped position, and a luminous means 24 adapted to enhance visibility.

Figure 3:
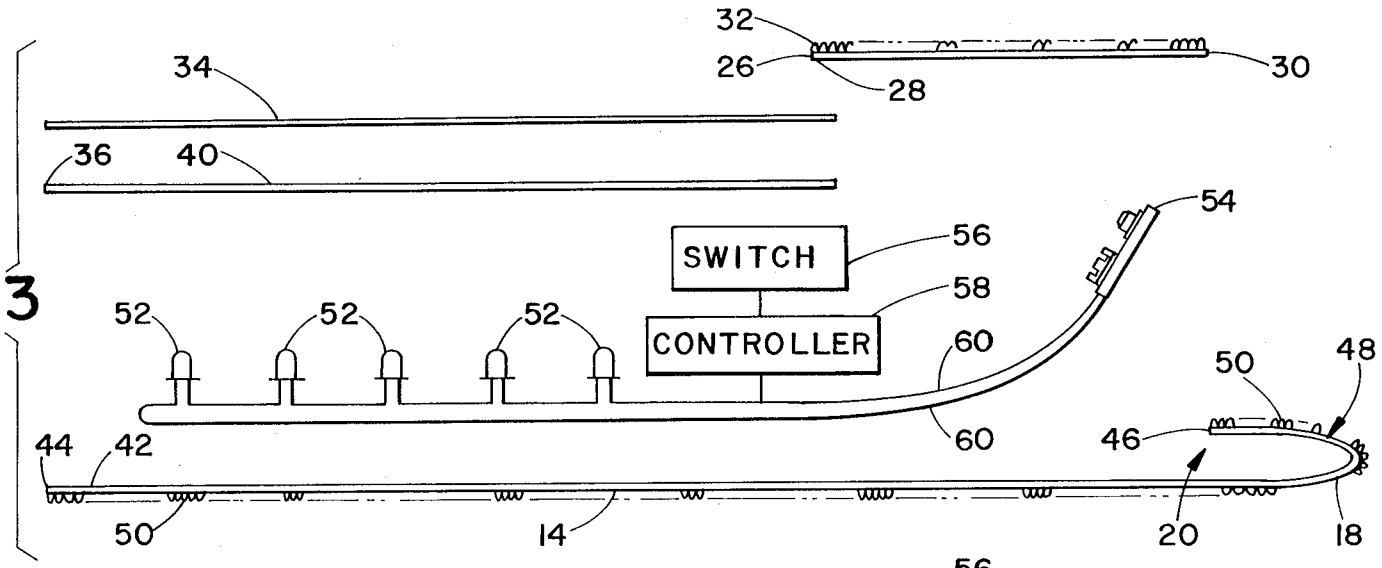
FIG. 3 is an exploded side view of the safety light band shown in FIGS. 1 and 2.

The strap 10 is shown in an exploded side view of components in FIG. 3. The strap 10 comprises flexible layers including a first fabric layer 26, a first plastic layer 34, a second plastic layer 36, and second fabric layer 42. The first fabric layer 26 has opposite ends 28 and 30, and bears a fastening surface 32 which forms a component of the fastening means 22. The fastening surface 32 is the hook surface of a hook and pile fastening means commonly known under the trademark "Velcro". The first plastic layer 34 is a clear plastic sheet. The second plastic layer 36 is a white plastic sheet bearing a reflective surface 40 which contrasts with the white plastic background of the sheet. The first fabric layer 26 and the plastic layers 34 and 36 may be considered as components of an overall front layer comprising the front planar side 12 of the strap 10. The rear planar side of the preferred embodiment comprises a single second fabric layer 42. The second fabric layer 42 has sufficient length between its opposite ends 44 and 46 to provide a portion 48 thereof when folded as shown in FIGURE 3. The portion 48 comprises a further component of the front side 12 of the strap 10, and may also be considered a component of an overall front layer of the assembled strap. The second fabric layer 42 bears a fastening surface 50 which is a pile surface adapted to be complementary to the hook surface 32 as a component of the fastening means 22.

With further reference to FIG. 3, the luminous means 24 includes electrical components disposed between the second fabric layer 42 and the other flexible layers 26, 34 and 36 of the strap 10. These electrical components include a plurality of electric lamps 52 which preferably are LED's emissive of red light. Associated with the lamps 52 are a battery connector 54, a switch 56, a controller 58, and electrical lines 60 connected to the lamps 52. This circuitry causes the lamps 52 to blink and will be described in detail hereinafter with reference to FIG. 4.

Figure 2:
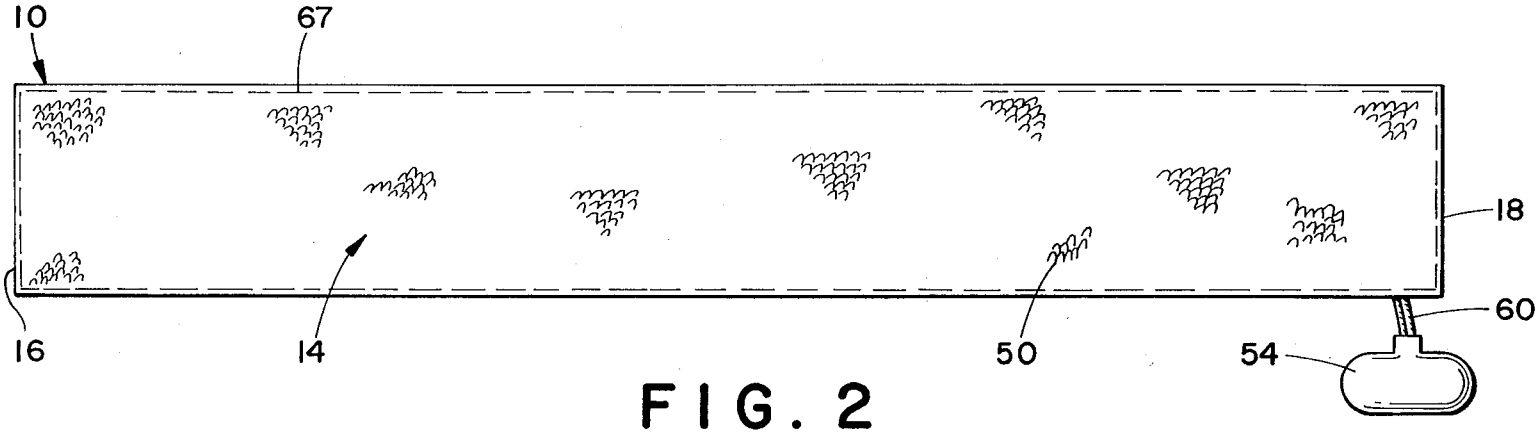
FIG. 2 is a rear elevation view of the safety light band shown in FIG. 1.

The components of the strap 10 shown in FIG. 3 are assembled into overlying contact to form the two sided structure shown in FIGS. 1 and 2. The battery pouch 20 is formed between the first and second fabric layers 26 and 42. The electrical lines 60 extend through the battery pouch 20 and out through a gap 62 provided between the end 30 of the first fabric layer 26 and the end 46 of the second fabric layer 42. The lamps 52 protrude through the first and second plastic layers 34 and 36 to be visible at the front side 12 of the strap 10. The assembled structure of the strap 10 shown in FIG. 1 provides the front side 12 with a cooperative arrangement of highly visible components of the luminous means 24. The reflective surface 40 and the contrasting white plastic of the second plastic layer 36 are visible through the clear plastic layer 34, whereby the white plastic renders the strap 10 highly visible in contrast to its surroundings, and the reflective surface 40 reflects both externally applied light and the light emitted from the lamps 52.

Since the intended use of the safety light band B almost certainly involves exposure to moisture, another feature of the composite construction of layers forming the strap 10 is the applicability of high frequency welding for joining the plastic layers 34 and 36. A water resistant or waterproof cover is thereby provided for the electric components. Furthermore, a welded seam 64 joining the clear plastic layer 34 to the white plastic layer 36 follows a rectangular path across the reflective surface 40 to divide it into separate areas 66 within waterproof pockets between the two plastic layers. A puncture of the clear plastic layer 34 at one such pocket will not cause the entire reflective surface 40 to become flooded over. Greater watertight protection can be obtained by forming layers 26 and 42 from plastic also, with overall assembly being completed with high frequency welding. However, in the preferred embodiment, fabric is used for durability and comfort.

While high frequency welding is preferred, other means of fastening may be employed. In the embodiment shown in the figures, the welded plastic layers 34 and 36 are joined with the fabric layers 26 and 42 by stitches 67. Importantly, the stitches 67 are disposed outside the boundary of the welding seam 64 defining waterproof pockets at the areas 66.

Figure 4:
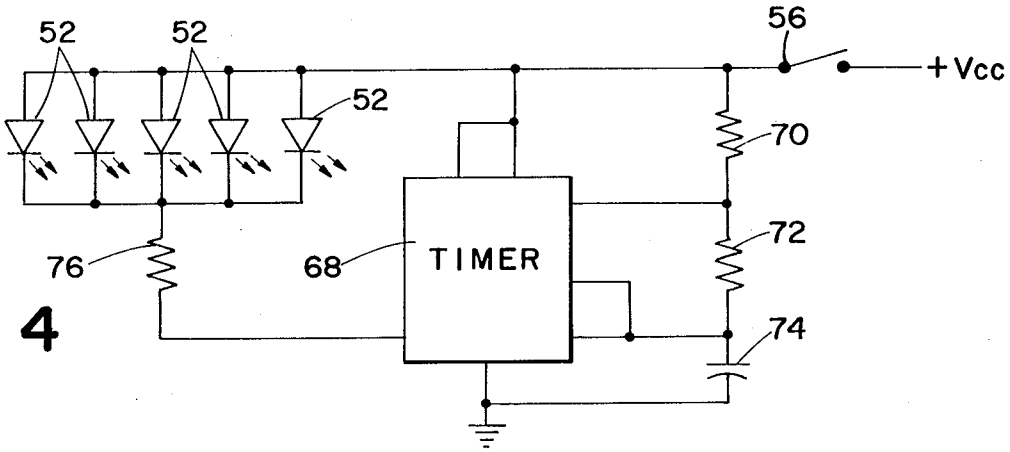
FIG. 4 is a circuit diagram showing electrical components in accordance with the invention.

Referring now to FIG. 4, there is shown a circuit adapted to operate the lamps 52 in accordance with the invention. In the preferred embodiment, the controller 58, shown schematically in FIG. 3, comprises a timer 68, a first resistor 70, a second resistor 72, and a capacitor 74. Other circuit components include a third resistor 76, the lamps 52, and the switch 56 for a connection with a positive voltage supply. The timer 68 is a 555 timer arranged as an astable multivibrator in a known manner with the first resistor 70 and the second resistor 72 connected in series with the capacitor 74. The timer output is high while the capacitor 74 is charging through the first and second resistors 70 and 72 toward the positive voltage supply, and is low while the capacitor 74 is discharging through the second resistor 72. The timer 68 flips the output at threshold levels of voltage across the capacitor 74 to drive the lamps 52 with a rectangular waveform output. The output frequency is a function of the charging and discharging rate of the capacitor 74. This charge and discharge rate is determined by the selected values of the first and second resistors 70 and 72 in accordance with known practice. The output cycle can be made to approach a symmetrical square wave by making the first resistance value low with respect to the second resistance value so that the high output time does not greatly exceed the low output time. In such an arrangement, the lamps 52 would be driven to blink on and off regularly to optimize visibility. The selection of component values in this circuit is conventional.

In use, the safety light band B provides clear and conspicuous visibility under any foreseeable conditions of darkness. First, the user attaches a battery at the battery connector 54. In the preferred embodiment, the safety light band B operates on a small 9 volt battery, a desired feature of the invention being light weight and compact size. The connected battery and extended electrical lines 60 are then tucked out of sight into the battery pouch 20 through the gap 62. The strap 10 is then wrapped around the user's arm, ankle, etc., with a portion of the pile surface 50 at the rear side 14 overlying the hook surface 32 at the front side 12. The switch 56 enables the lamps 52 to light up or to blink in accordance with the particular selection of a controller 58. The components of the luminous means 24 can all interact to enhance the visibility of the safety light band B since the reflective surface 40 reflects externally directed light, such as from a motor vehicle, as well as the internally produced light emitted from the lamps 52. The safety light band B is thus easily identifiable by a motorist, and also attracts attention to itself in an environment of total darkness.

The invention has been described with reference to the preferred embodiment. Obviously, modifications and alterations will occur to others upon the reading and understanding of this specification. For example, in the above described wrapped position of the strap 10, the gap 62 is covered by the rear side 14 whereby the battery remains securely housed in the pouch 20 throughout vigorous activity of the wearer. However, an alternate location of the gap 62 could be arranged, such as at the strap ends 16 or 18, or the rear side 14, since alternate arrangements of the hook and pile surfaces 32 and 50 could be devised to enable appropriately alternate positions of the strap. The composite layered construction also permits variations in the arrangement of layers bearing reflective surfaces. The reflective surface 40 could be arranged in a pattern other than the rectangular one shown, and could be initially provided as an independent layer component, as could an alternately devised white plastic background. A further modification could include the utilization of a single uniformly reflective surface. It is intended to include all such modifications insofar as they come within the scope of the appended claims or equivalents thereof.

Having thus described the invention, it is claimed:

1. A safety light band for increasing the visibility of a person wearing the band comprising:

a strap adapted to wrap a limb of said person and being formed in a structure of layered components comprising front and rear strap layers defining front and rear planar sides of said strap;

a pouch formed within said strap between said front and rear sides, said pouch being adapted to house a battery;

luminous means including a reflective surface at said front of said strap, a plurality of electric lamps, a battery connector, electric lines extending between said lamps and said battery connector, said battery connector being receivable in said pouch in an operative band-wearing position with said electric lines contained within said strap between said front and rear sides, said lamps being disposed between said front and rear sides of said strap with said lamps protruding through said front layer to be visible at said front side and, said front strap layer being comprised of layered components including a first plastic layer bearing said reflective surface and a transparent second plastic layer overlying said first plastic layer, said reflective surface being disposed in a pattern of areas having relatively contrasting reflectivity, and said first and second plastic layers being adhered with a watertight seal delineating said areas and forming corresponding watertight pockets between said plastic layers.

* * * * *